US010100611B2

(12) United States Patent
Hill, Jr. et al.

(10) Patent No.: US 10,100,611 B2
(45) **Date of Patent: *Oct. 16, 2018**

(54) DEEP SET SUBSURFACE SAFETY VALVE WITH A MICRO PISTON LATCHING MECHANISM

(71) Applicant: Tejas Research and Engineering, LLC, The Woodlands, TX (US)

(72) Inventors: Thomas G. Hill, Jr., Conroe, TX (US); Robert C. Henschel, The Woodlands, TX (US)

(73) Assignee: Tejas Research & Engineering, LLC, The Woodlands, TX (US)

( * ) Notice: Subject to any disclaimer, the term of this patent is extended or adjusted under 35 U.S.C. 154(b) by 164 days.

This patent is subject to a terminal disclaimer.

(21) Appl. No.: 15/238,446

(22) Filed: Aug. 16, 2016

(65) Prior Publication Data

US 2016/0356121 A1 Dec. 8, 2016

Related U.S. Application Data

(63) Continuation of application No. 13/946,017, filed on Jul. 19, 2013, now Pat. No. 9,441,456.

(60) Provisional application No. 61/673,513, filed on Jul. 19, 2012.

(51) Int. Cl.

| | |
|---|---|
| ***E21B 34/10*** | (2006.01) |
| ***E21B 34/12*** | (2006.01) |
| *E21B 34/00* | (2006.01) |

(52) U.S. Cl.

CPC ..... *E21B 34/102* (2013.01); *E21B 34/12* (2013.01); *E21B 2034/005* (2013.01)

(58) Field of Classification Search

CPC .. E21B 2034/005; E21B 34/10; E21B 34/102; E21B 2034/002

See application file for complete search history.

(56) References Cited

U.S. PATENT DOCUMENTS

| | | | | |
|---|---|---|---|---|
| 3,696,868 | A * | 10/1972 | Taylor, Jr. | E21B 34/106 137/384.8 |
| 4,356,867 | A * | 11/1982 | Carmody | E21B 34/102 166/237 |
| 4,444,266 | A | 4/1984 | Pringle | |
| 4,986,357 | A | 1/1991 | Pringle | |
| 5,310,004 | A * | 5/1994 | Leismer | E21B 34/10 166/321 |
| 5,810,087 | A * | 9/1998 | Patel | E21B 34/102 166/323 |
| 6,202,747 | B1 * | 3/2001 | Lacy | E21B 33/1295 166/120 |

(Continued)

OTHER PUBLICATIONS

USPTO Office Action for U.S. Appl. No. 13/946,017 dated Dec. 7, 2015.

(Continued)

*Primary Examiner* — Kipp C Wallace
(74) *Attorney, Agent, or Firm* — Tumey L.L.P.

(57) ABSTRACT

A subsurface safety valve is operable to close a fluid flow path by virtue of an axially movable flow sleeve. The valve includes a recockable actuator and a latch mechanism so that the valve can be moved to a closed position without overcoming the pressure head and frictional forces currently encountered in conventional safety valves. The latch mechanism includes one or more micro pistons.

10 Claims, 5 Drawing Sheets

(56) References Cited

U.S. PATENT DOCUMENTS

| | | | | |
|---|---|---|---|---|
| 6,433,991 | B1 * | 8/2002 | Deaton | E21B 23/00 166/65.1 |
| 8,002,042 | B2 * | 8/2011 | Going, III | E21B 34/066 166/332.8 |
| 8,186,439 | B2 | 5/2012 | Lauderdale | |
| 2004/0069496 | A1 * | 4/2004 | Hosie | E21B 7/061 166/373 |
| 2004/0129423 | A1 * | 7/2004 | Eddison | E21B 21/103 166/321 |
| 2007/0187107 | A1 | 8/2007 | Pringle | |
| 2008/0314599 | A1 * | 12/2008 | Bane | E21B 23/04 166/375 |
| 2012/0006553 | A1 * | 1/2012 | Korkmaz | E21B 23/006 166/332.8 |
| 2012/0067594 | A1 * | 3/2012 | Noske | E21B 34/08 166/373 |
| 2015/0083430 | A1 * | 3/2015 | Jahnke | E21B 33/038 166/338 |

OTHER PUBLICATIONS

USPTO Notice of Allowance for U.S. Appl. No. 13/946,017 dated May 12, 2016.

* cited by examiner

DEEP SET SUBSURFACE SAFETY VALVE WITH A MICRO PISTON LATCHING MECHANISM

This application is a continuation application of U.S. patent application Ser. No. 13/946,017, filed Jul. 19, 2013 which claims priority to the U.S. Provisional Application No. 61/673,513 filed on Jul. 19, 2012.

BACKGROUND OF INVENTION

1. Field of the Invention

This application is directed to a subsurface safety valve system for use in drilling oil or gas wells. Such valves are commonly used to prevent flow of oil or gas from the well to the surface when certain conditions occur.

2. Description of Related Art

Currently such safety valves are held in an open position by virtue of pressure in a control line from the surface acting on a piston in the valve which is operatively connected to a flow sleeve which moves axially to open a valve member. Movement of the sleeve also compresses a spring surrounding the flow sleeve.

Upon the occurrence of an unfavorable event, the pressure is relieved via the control line so that the spring will move the flow sleeve upwardly so as to allow the valve, which may be a flapper valve to close. In so doing, the spring must overcome the pressure head caused by the hydraulic fluid and the flow resistance due to the small diameter of the control line.

Some control lines in deep water subsea wells may be up to two miles or more in length and may extend a vertical distance of more than a mile.

Consequently the pressure head and resistance to flow is quite high which can delay the response time for the valve and may in some cases result in failure.

FSSD—or fail safe setting depth is a term known to all skilled in the art of Surface Controlled Subsurface Safety Valves (SCSSVs) and is discussed in detail in API-14A, the primary document controlling certification of all such valves.

Simply put, the FSSD is the depth at which a SCSSV may not be set below because the force caused by the pressure head of a column of fluid in the control line from the surface acting on the valve's actuating piston is greater than the force of spring acting to close the valve.

In deep set valves, it is impossible to employ a spring large enough to close the valve so a gas charge, normally nitrogen, is commonly used to offset a portion of the force of the pressure head, thereby allowing the valve to operate somewhat normally. In the nitrogen chamber, often a low lubricity oil is positioned between the piston seals and the nitrogen to protect the piston seals, and to reduce the effects of wear as the piston cycles repeatedly between open and closed. The term "somewhat" is used here due to the compressible nature of gasses.

Pressure Charged SCSSVs actually have a "Fail Safe Setting Window" which is not absolute because of the changing nature of the downhole environment and its own particular wear characteristics. Normally deep set SCSSV's are utilized in deep ocean environments where temperatures are near freezing—33-40 degrees F. (or 1-3 degrees C.). SCSSVs are typically set 100 meters below the mud line of the ocean floor, and are influenced by these temperatures. The temperature of the producing formation can be 300-400 Fahrenheit, meaning the SCSSV can warm to these temperatures during production of the well. However, if the well is shut-in the temperature can rapidly cool to that of the ocean floor.

The result is that in a constant volume chamber, the pressure changes dramatically with temperature in application of Boyle's and Charles' Law: P1/T1=P2/T2. Therefore, in a gas charged SCSSV, as the nitrogen chamber warms to, for example, 350 deg F., the nitrogen is able to offset a greater pressure head than when it has cooled to 33 Deg F. during shut in. Over time, repeated open and closing cycles cause minute longitudinal scratches in the piston bore and on the seals thereby allowing small amounts of oil to leak past the seals. With enough cycles, the seals can fail causing the nitrogen to leak off, triggering a highly complex valving system to auto-execute to prevent failure of the valve in the open position—if it works properly—and the above described "non-fail safe" scenario has not happened. This is a characteristic and risk assessment associated with all prior art deep set SCSSVs.

What is known to all SCSSV designers is that reducing the piston area increases FSSD. Obviously, the opening force exerted by the control line fluid is equal to the pressure head times the piston area. As piston area approaches zero, FSSD approaches infinity.

However, until the present invention there has always been a practical limitation of piston diameter. When the valve is closed the operating piston exists happily completely enclosed in the piston bore. However, as the valve opens, the piston strokes out of the bore and extends itself as a cantilevered beam until the valve is open. The length of the cantilevered piston is always greater than the flapper diameter, as it must push the flow tube to fully open the flapper.

The cantilevered piston has two possible loading conditions; the first as a column, as the power spring places compressive force on the unsupported piston; the second in bending, as the repeated cyclic compression of the spring places a radial load on the cantilevered piston, AND the combination of both of these loads. The piston resists these forces by the yield strength of the material and its Moment of Inertia. Designers already use the strongest, most noble materials known. The problem is reducing Moment of Inertia by reducing diameter. If the piston gets too long and skinny, it will fail due to elastic instability, bending, or both.

For this reason, most pistons have a practical diameter of ½ or ⅜ of an inch. In small tubing sized valves, pistons have been known to be ¼ inch.

The short length of the micro piston in accordance with the instant invention allows practical diameters below ¼ of an inch and practically can be used at diameters of 0.100 inches or even 0.050 inches. The stroke of the micro-piston to release the flow tube is very small as well, as an example less than 1 inch. This means the micro-piston has much lower wear characteristics, may be used at depths of 15,000 feet or even deeper without a gas charge, and is virtually unaffected by gas accumulation in the annulus. The micro-piston, because of its short stroke, may also cycle 20,000 or 30,000 times before predicted failure.

BRIEF SUMMARY OF THE INVENTION

The above mentioned design defects are overcome by the current invention. A recockable actuator is located within the valve body that is not subject to the pressure head or flow line resistance to move the flow sleeve to close the valve. When the flow sleeve is moved to a position which opens the valve, a latching mechanism which includes a micro piston engages the flow sleeve to hold it in place and the actuator is disengaged from the flow sleeve. To close the valve, the latch mechanism is disengaged and the flow sleeve will move upwardly by virtue of the compressed spring without having to overcome the pressure head or fictional forces.

BRIEF DESCRIPTION OF THE SEVERAL VIEWS OF THE DRAWING(S)

DETAILED DESCRIPTION OF THE INVENTION

Figure 1:
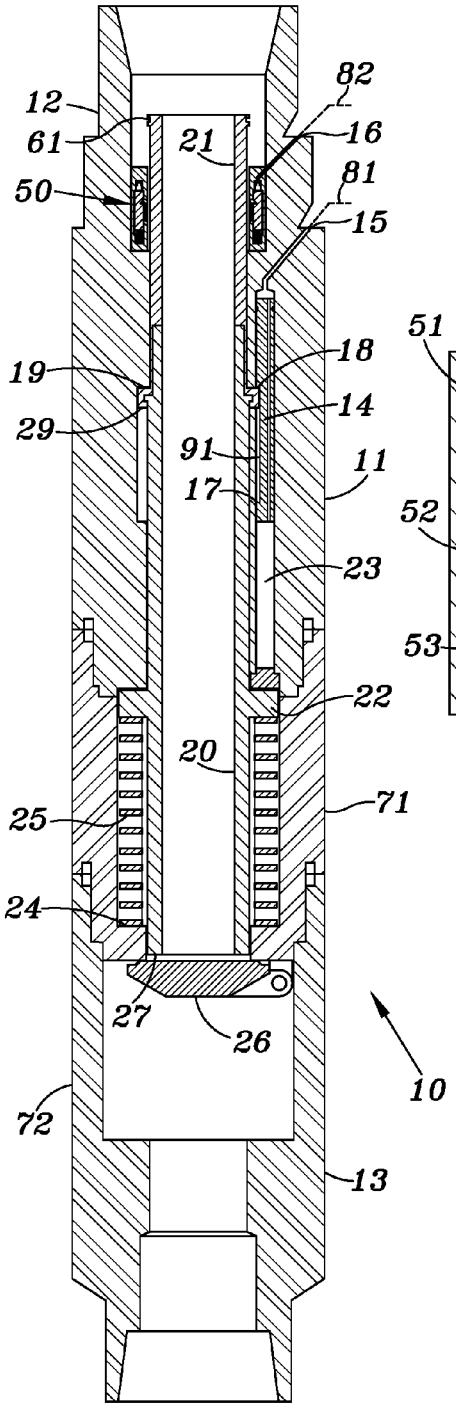
FIG. 1 is a cross-sectional view of an embodiment of the safety valve in the closed position.

FIG. 1 illustrates an embodiment of a deep set surface controlled subsurface safety valve according to the invention. Such valves are typically positioned below the sea floor at a depth that is limited by the design characteristics of the valve. As shown in FIG. 1, safety valve 10 includes a main housing or body which includes three sections 11, 71 and 72 suitably connected to each other. Safety valve 10 has an inlet 12 for connection to a tubular for example, production tubing and an outlet 13 for connection to a tubular which may be production tubing. Safety valve 10 includes a flow sleeve 20, coil spring 25, flapper valve 26 biased to a closed position and an axially movable piston 14, located with housing portion 11. Uphole portion 21 of the flow sleeve includes an annular groove 61 formed between two radially projecting flanges. A latching mechanism 50 shown in detail in FIG. 2 surrounds the uphole portion 21 of the flow sleeve and is secured within housing portion 11.

Figure 5:
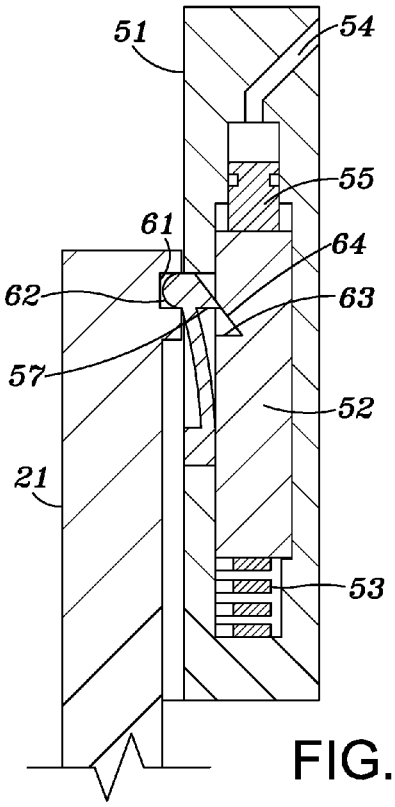
FIG. 5 is an enlarged view of the latching mechanism.

Latching mechanism 50 includes an annular body 51 having an interior annular chamber within which is located an annular ring 52 and a coil spring 53. Annular ring has an annular groove 63 shown in FIG. 5 therein with a beveled surface 64 shown in FIG. 5.

One or more micro pistons 55 are located within body 51 such that one end of the micro piston is exposed to a control line 54 for pressurized fluid and the other end of the piston is in contact with annular ring 52.

Figure 2:
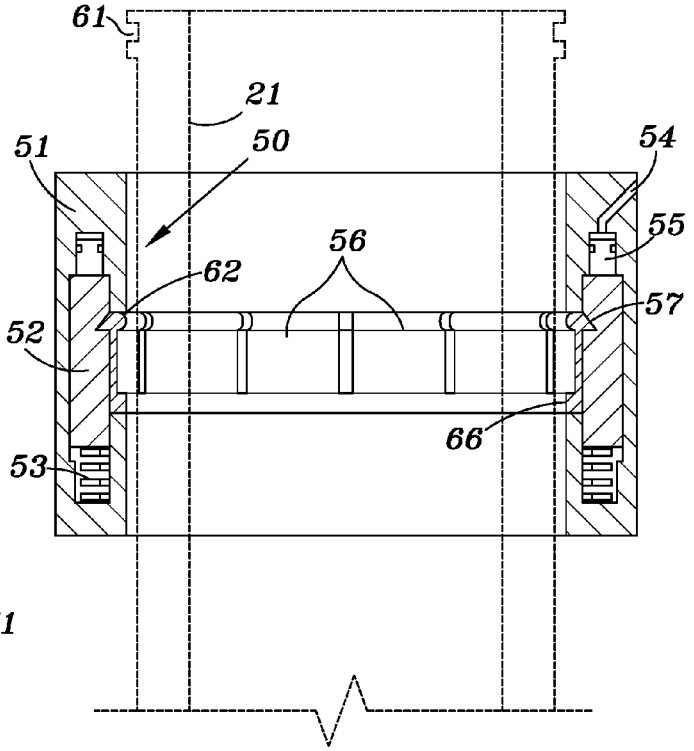
FIG. 2 is a cross-sectional view of the micro piston latching mechanism according to an embodiment of the invention.

An annular collet 66 is positioned in an interior surface of body 51 and includes a plurality of flexible resilient fingers 56. Fingers 56 have a rounded inwardly extending tab 62 that is adapted to be captured by groove 61 in the uphole portion of flow sleeve 21. Fingers 56 also each have an outwardly extending sloping surface that terminates with an edge 57 that is adapted to be positioned within an annular, complimentary shaped groove 63 in the ring member 52. Downward movement of ring member 52 as shown in FIG. 2 is resisted by the coil spring 53.

In the position shown in FIG. 1, the flapper valve 26 is in the closed position against valve seat 27 and consequently there is no flow through the valve. In order to open the valve, fluid under pressure is conveyed to inlet 15 via a control line 81 that extends to the surface. The fluid pressure against the uphole surface of piston 14 will cause it to move downwardly looking at FIG. 1. As it moves a shoulder 18 on the piston engages an outwardly extending flange 29 on the flow sleeve and moves the flow sleeve downwardly thus pushing flapper valve 26 to an open position shown in FIG. 3 and compressing spring 25.

Figure 3:
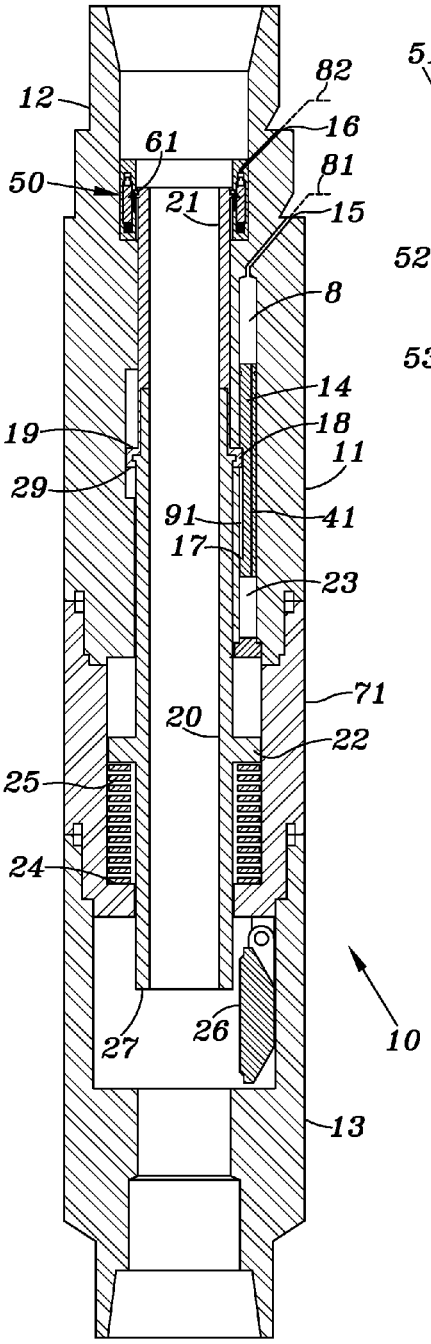
FIG. 3 is a cross-sectional view of an embodiment of the safety valve in the open position.
Figure 4:
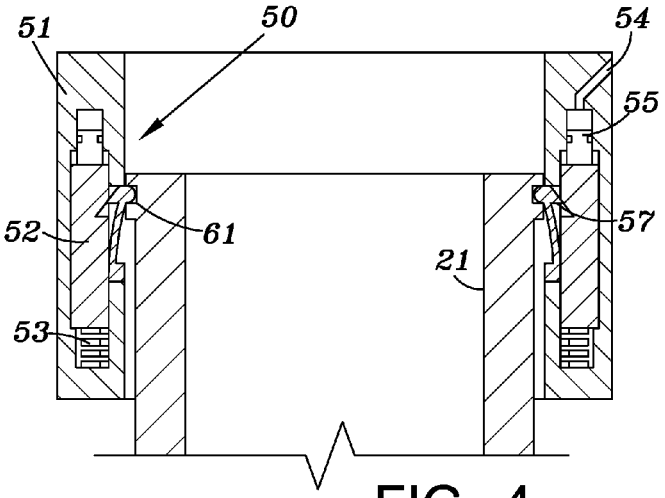
FIG. 4 is a cross-sectional view of the latching mechanism shown with the safety valve in the open position.

At this point annular groove 61 formed on the outer surface of flow sleeve 21 comes into registry with the rounded tabs 62 on the flexible fingers 56 of the latching mechanism. As fluid pressure is applied to the upper end of micro piston or pistons 55 via inlet 54 and control line 82 which extends to the surface, one or more micro pistons push on ring member 52. Due to the beveled surfaces in groove 63 and fingers 56, downward movement of the ring will cause rounded tabs 62 to be moved radially inward and captured by ring 61 shown in FIG. 4 thus locking flow sleeve and flapper valve 26 in an open position as shown in FIG. 3. Downward movement of the ring 52 also compresses spring 53.

Figure 6:
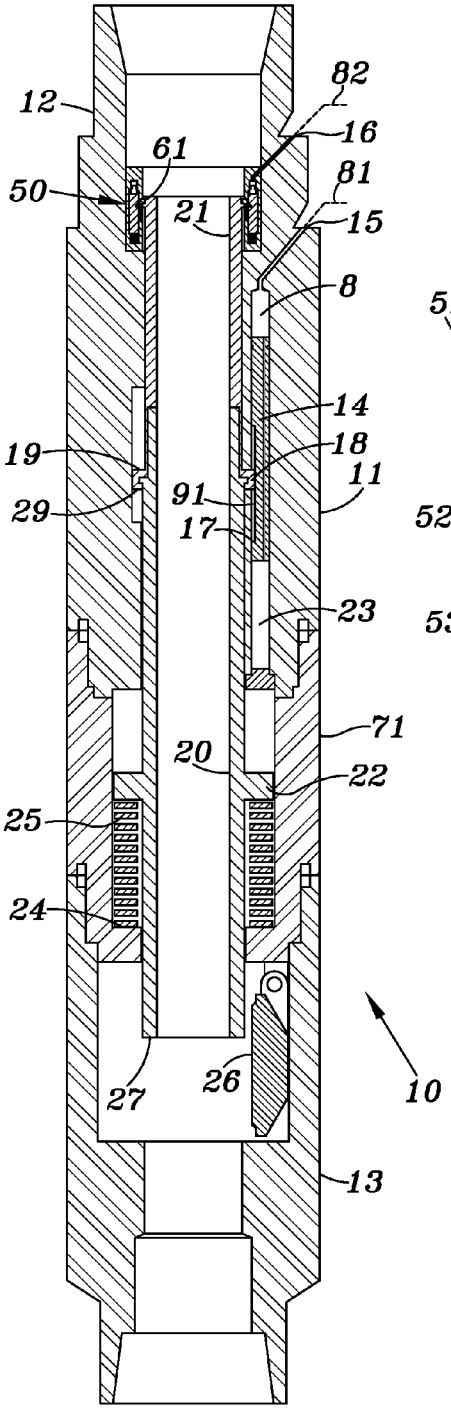
FIG. 6 is a cross-sectional view of the safety valve of FIG. 1 in an open, balanced piston condition.
Figure 7:
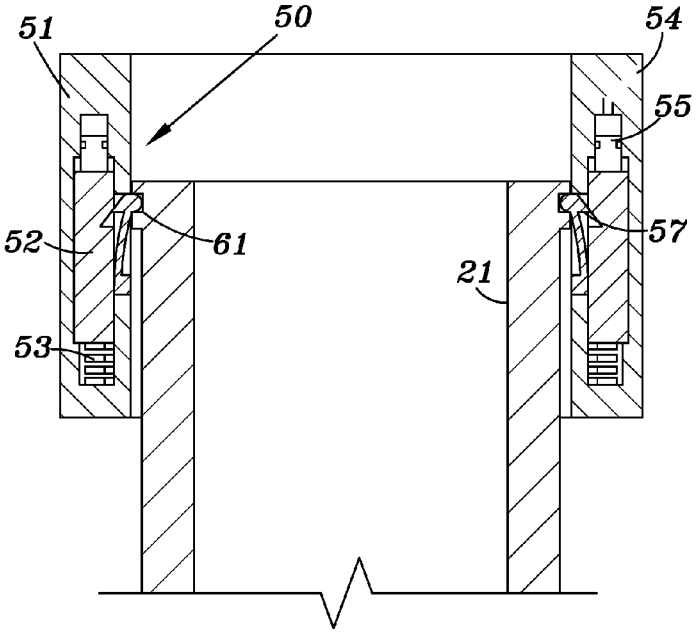
FIG. 7 is a cross-sectional view of the latching mechanism when the safety valve is in the position shown in FIG. 6.

Piston 14 includes a longitudinally extending small diameter bore 41 that will allow the pressure to eventually equalize on both ends of the piston so that piston 14 will move upwardly as shown in FIG. 6 after a predetermined period of time. A slot 91 is provided in the lower portion of piston 14 so that it does not engage shoulder 18 as it moves upwardly.

Should circumstances occur which require that the valve be in the closed position, pressure within control line 82 is relieved thus relieving the pressure on the uphole surface of micro piston(s) 55.

Figure 8:
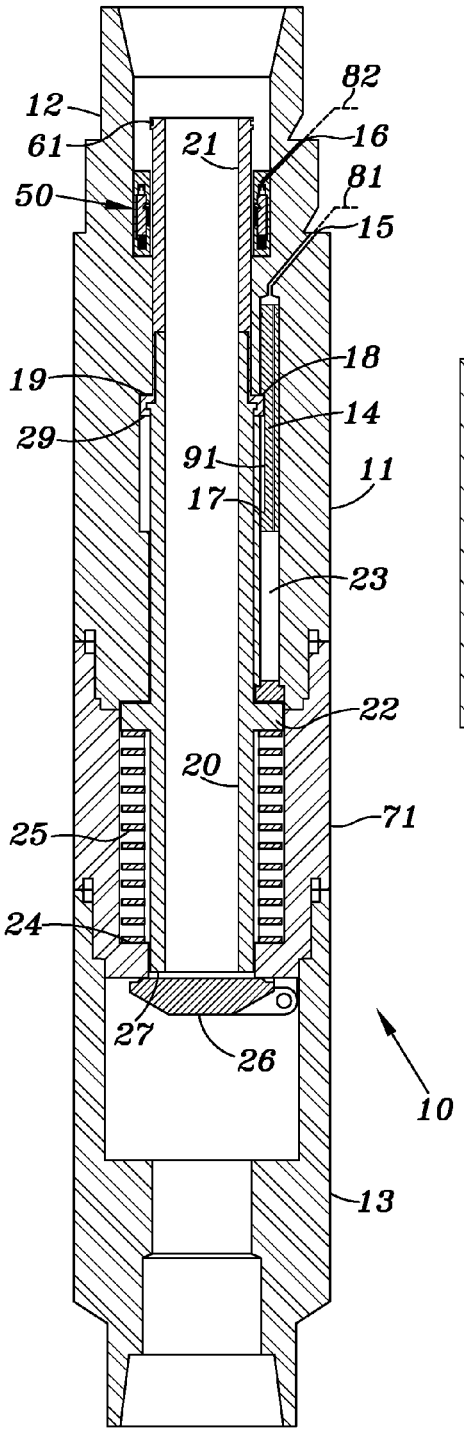
FIG. 8 is a cross-sectional view of the safety valve of FIG. 1 with the flow tube moved back to the close position.
Figure 9:
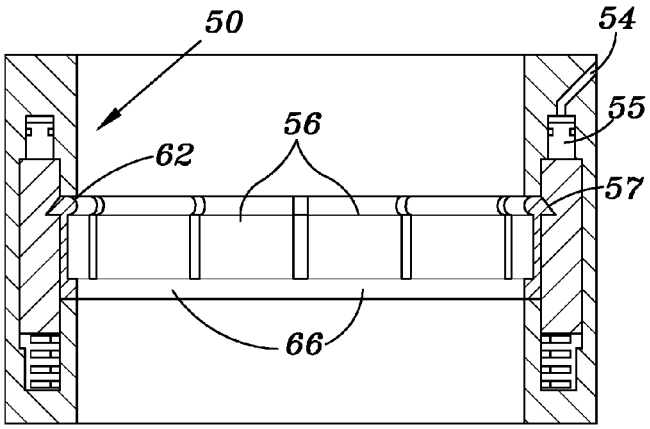
FIG. 9 is a cross-sectional view of the latching mechanism when the valve is in the closed position shown in FIG. 8.

With the fluid pressure relieved, compressed coil spring 53 will move ring 52 upwards as shown in FIG. 9. Flexible, resilient fingers 56 will now return to their neutral position and in so doing tabs 62 will move out of annular ring 61 thereby releasing the uphole portion 21 of the flow sleeve. Coil spring 25 which was compressed during the opening of the valve will now move flow sleeve 20 in an upward direction by acting on shoulder 22 on the flow sleeve. This movement will allow flapper valve 26 to close on valve seat 27 and the valve will be in the closed position as shown in FIG. 8. As the flow sleeve is moved upward there are minimal forces that must be overcome as the piston 14 has previously moved to the position shown in FIG. 6.

Figure 10:
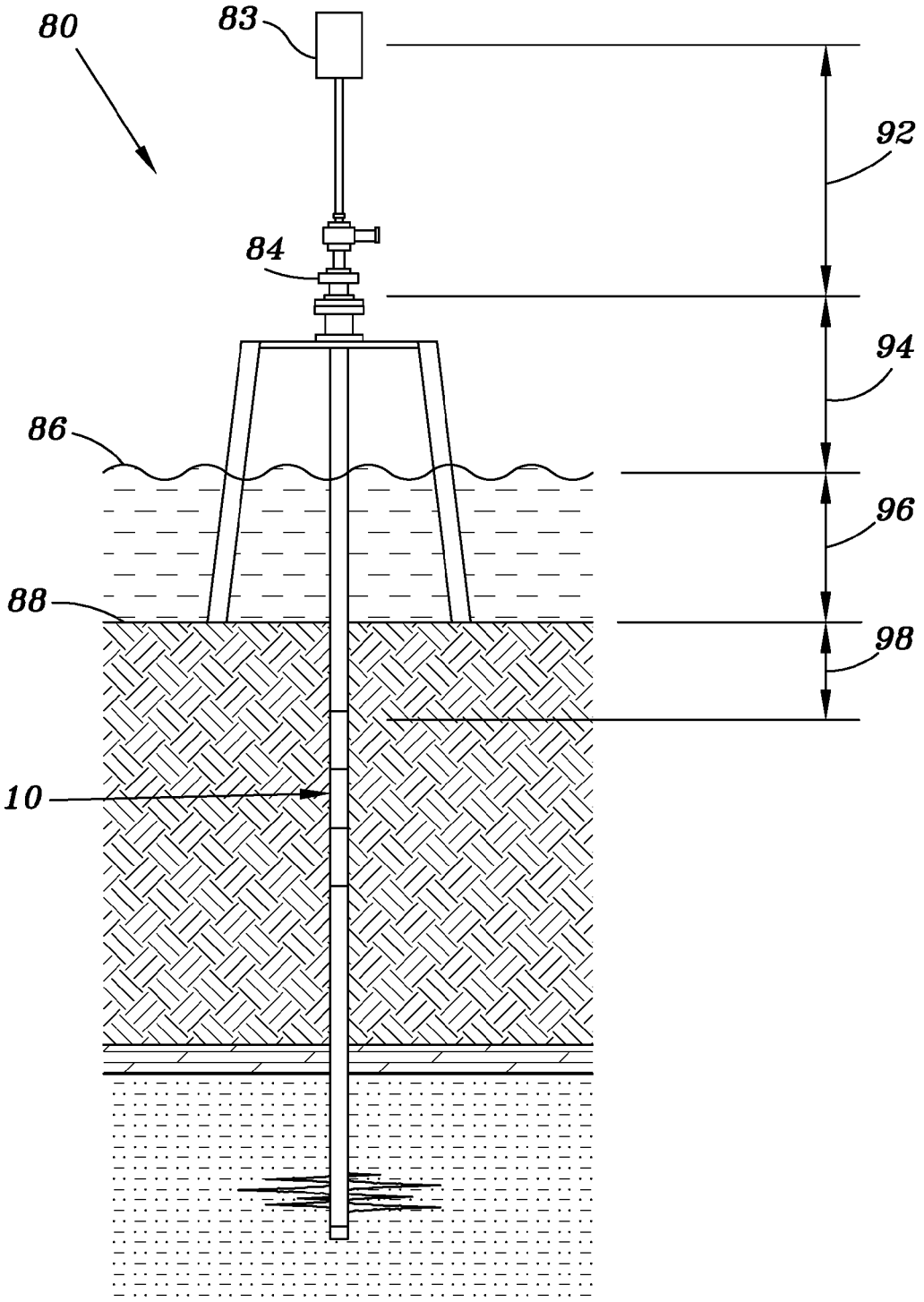
FIG. 10 illustrates the factors that are used in calculating the failsafe setting depth.

FIG. 10 illustrates an example of a surface controlled subsurface safety valve. The installation includes a rotary Kelly bushing 83, tubing hanger 84, water level 86, mudline 88 and subsurface valve 10. Distance 92 is the elevation, distance 94 is the air gap, distance 96 is the water depth and distance 96 is the valve depth.

The failsafe setting depth (FSSD) is equal to 0.85 Pc/MHFG wherein:

Pc=minimum closing pressure, psi

MHFG=maximum hydraulic fluid gradient, psi per foot (psi per foot=ppg×0.052)

For example, if the completion fluid is $CaCl_2$, ppg max is 9 ppg. Assuming a minimum closing pressure of 800 psi, $$MHFG = 9.0 \times 0.052 = 0.468 \text{ psi per foot}$$

$$FSSD = \frac{0.85 \times 800}{0.468} = 1{,}453 \text{ ft.}$$

Although the present invention has been described with respect to specific details, it is not intended that such details should be regarded as limitations on the scope of the invention, except to the extent that they are included in the accompanying claims.

We claim:

1. A safety valve comprising:

a) a body, b) an axially moveable flow sleeve positioned within the body and having a substantially constant internal diameter, c) a valve element pivotably mounted within the body between an open and closed position, d) a recockable actuator within the body for moving the flow sleeve in a downhole direction, and disengaging from the flow sleeve when the valve is in the open position, the recockable actuator including a piston within a chamber the piston including a bore extending there through and, e) a latching mechanism for locking and unlocking the flow sleeve in a given position.

2. A safety valve according to claim 1 wherein said latching mechanism includes a micro piston.

3. A safety valve according to claim 1 wherein the piston includes an axially extending notch on an exterior surface thereof.

4. A safety valve according to claim 3 wherein the notch includes a shoulder adapted to engage a flange on the flow sleeve to thereby move the flow sleeve in a downward direction as the piston moves in a downward direction.

5. A safety valve according to claim 4 wherein the length of the notch is greater than that of the flange so that there is lost motion between the flow sleeve and the piston when the piston moves in an upward direction.

6. A safety valve comprising:

a) a body, b) a flow sleeve positioned within the body and axially movable, c) a valve element pivotably mounted within the body between an open and closed position, d) a recockable actuator within the body for moving the flow sleeve in an axial direction, and disengaging from the flow sleeve when the valve is in the open position, e) a latching mechanism for locking and unlocking the flow sleeve in a given position, wherein the latching mechanism comprises:

an annular body having an interior chamber, an annular ring, and an annular collet.

7. A safety valve according to claim 6 wherein the annular collet includes a plurality of flexible fingers having an outwardly extending sloping surface that terminates with an edge which is adapted to fit within a groove provided in the annular ring.

8. A safety valve according to claim 7 wherein the fingers also include an inwardly extending tab adapted to be captured by an annular groove provided on an exterior surface of the flow sleeve.

9. A safety valve according to claim 6 wherein the annular ring is axially moveable within the interior chamber, and at least one micro piston located within the interior chamber for moving the ring in an axial direction.

10. A safety valve according to claim 9 further comprising a spring located in the interior chamber between the annular ring and the annular body.

* * * * *